US006519904B1

(12) United States Patent
Phillips

(10) Patent No.: US 6,519,904 B1
(45) Date of Patent: Feb. 18, 2003

(54) METHOD OF FORMING CONCRETE WALLS FOR BUILDINGS

(76) Inventor: Charles N. Phillips, 8135 Jackrabbit Rd., Houston, TX (US) 77095

( * ) Notice: Subject to any disclaimer, the term of this patent is extended or adjusted under 35 U.S.C. 154(b) by 174 days.

(21) Appl. No.: 09/728,855

(22) Filed: Dec. 1, 2000

(51) Int. Cl.[7] ..... E04B 2/02; E04B 2/84

(52) U.S. Cl. ..... 52/309.12; 52/309.17; 52/344; 52/454; 52/745.09; 52/742.14; 52/741.41

(58) Field of Search ..... 52/309.12, 309.17, 52/344, 364, 800.12, 443, 454, 741.41, 742.14, 745.09, 745.1, 250, 259

(56) References Cited

U.S. PATENT DOCUMENTS

| | | | | | |
|---|---|---|---|---|---|
| 4,193,240 | A | * | 3/1980 | Odoerfer | 52/344 |
| 4,633,634 | A | * | 1/1987 | Nemmer et al. | 52/474 |
| 4,641,469 | A | * | 2/1987 | Wood | 52/309.12 |
| 4,970,838 | A | | 11/1990 | Phillips | |
| 5,033,248 | A | | 7/1991 | Phillips | |
| 5,335,472 | A | | 8/1994 | Phillips | |
| 5,381,635 | A | * | 1/1995 | Sanger | 52/251 |
| 5,524,400 | A | * | 6/1996 | Schmechel | 52/474 |
| 5,722,198 | A | * | 3/1998 | Bader | 52/745.09 |
| 5,893,248 | A | * | 4/1999 | Beliveau | 52/309.7 |
| 5,966,885 | A | * | 10/1999 | Chatelain | 52/309.4 |
| 6,044,603 | A | * | 4/2000 | Bader | 52/309.7 |
| 6,263,628 | B1 | * | 7/2001 | Griffin | 52/309.12 |
| 6,363,674 | B1 | * | 4/2002 | Carver | 52/309.8 |

FOREIGN PATENT DOCUMENTS

GB 2713835 * 10/1986

* cited by examiner

*Primary Examiner*—Robert Canfield
(74) *Attorney, Agent, or Firm*—Browning Bushman, P.C.

(57) ABSTRACT

A vertical reinforced concrete wall for a concrete building including a plurality of insulating panel units horizontally spaced from each other each formed of a polystyrene foam material having a rectangular shape. A pair of channel-shaped vertical side members having side flanges and inturned lips on the side flanges are fitted over the side edges of the insulating panel on site with the lips biting into the insulation panel to secure the side members thereon. The plurality of spaced insulating panel units are mounted between a pair of opposed upper and lower channel-shaped track members which extend horizontally to define the upper and lower ends of the vertical wall. The units are spaced from each other a predetermined distance, such as eight (8) inches, to form space for a vertical concrete column between adjacent insulating panel units.

15 Claims, 4 Drawing Sheets

33
18
20
23
26
22
29
29
10
16
50
44
42
54
49
60
48
29
12
28
25
14

30
34
32
38
40
49
42
44
50
34
49
60
38
40
54
24
30

30
24
54
44
38
40
49
32
42
60
52
49
34
38
40
24
30

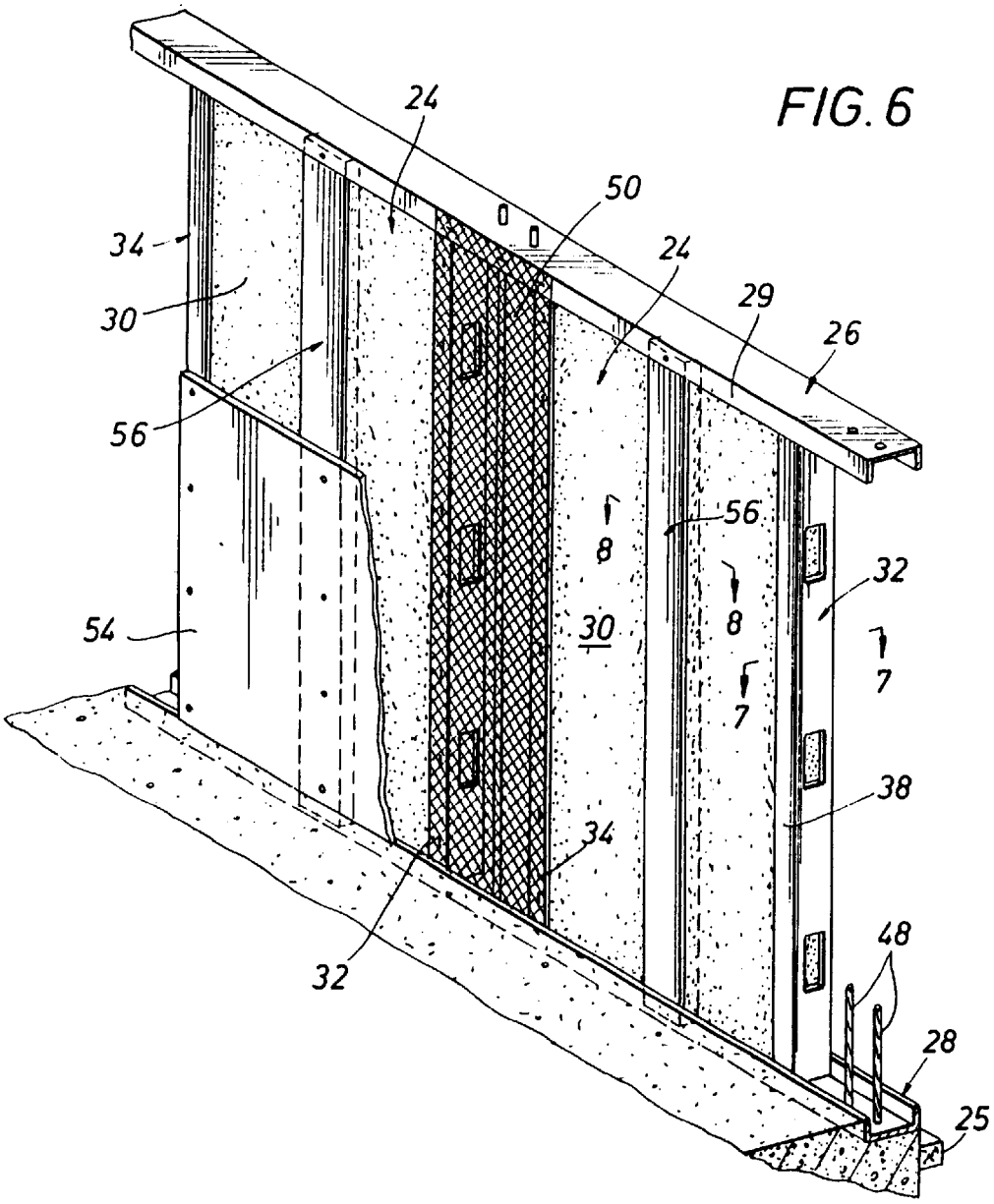
FIG. 6
FIG. 7
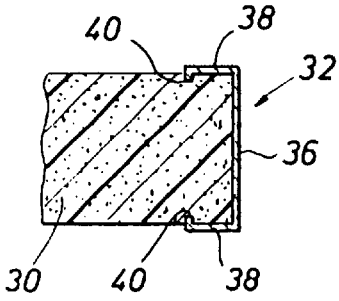
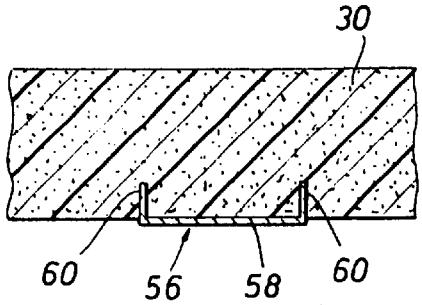
FIG. 8

METHOD OF FORMING CONCRETE WALLS FOR BUILDINGS

FIELD OF THE INVENTION

This invention relates to a method of forming vertically extending concrete walls for buildings from concrete applied pneumatically.

BACKGROUND OF THE INVENTION

U.S. Pat. Nos. 4,970,838; 5,033,248; and 5,335,472 are directed to a method for forming concrete walls for buildings from concrete applied pneumatically and utilizing a plurality of prefabricated modules. The prefabricated modules are constructed offsite and transported to the construction site. An outer rectangular frame is fitted about a layer of insulating material with wire mesh material secured to the frame on opposed sides of the insulating material to form the prefabricated module. The prefabricated rectangular modules are mounted on site with the outer metal frame positioned between upper and lower channel-shaped support members defining the upper and lower ends of the walls. Concrete is applied pneumatically against the modules with an outer layer of concrete being about two or three inches in thickness. Reinforced concrete columns are formed between adjacent modules. Concrete may be applied pneumatically to the interior of the wall or, if desired, wallboard may be secured to the interior surface of the modules. Each prefabricated module thus has an outer rectangular metal frame extending about its entire outer periphery.

BRIEF SUMMARY OF THE INVENTION

The present invention is directed to a method of forming a concrete wall for buildings in which the wall is formed entirely on site without the use of prefabricated modules. As a result, a prefabricated rectangular frame about the entire periphery of the insulating member, such as polystyrene, is not required.

The wall is formed between a lower channel-shaped base plate and an upper channel-shaped top plate. First, the insulation layer preferably formed of polystyrene is pre-cut for fitting between the upper and lower channel-shaped horizontal support plates. Metal side frame member or studs, preferably formed of aluminum have a channel shape with inturned lips or tabs extending inwardly from the flanges of the channel-shaped side frame members. The inturned lips are snapped about opposed sides of the insulation panel to form a unit. Next, the unit of an insulation layer and opposed side frame members are fitted between the upper and lower channel-shaped metal support plates and secured therebetween by metal screws through adjacent flanges of the plates and frame members. A plurality of such units may be mounted between upper and lower channel-shaped plates horizontally spaced about eight (8) inches from each other and reinforced columns are formed in the space between adjacent units. For this purpose, a small mesh screen having openings about 1/16th inch in width is secured to flanges of adjacent units to form a backing for the pneumatically applied concrete. If desired, wallboard panels may be secured to the interior surface of the insulation panel to form the interior surface of the wall.

It is an object of the invention to provide a concrete wall for a building which may be installed in a minimum of time with minimal cost.

Another object of the present invention is to provide a construction unit for walls which is assembled on site to receive pneumatically applied concrete.

Further objects, features and advantages of the invention will be apparent from he following specification and drawings.

BRIEF DESCRIPTION OF THE DRAWINGS

FIG. 6 is a perspective view of a rear portion of the reinforced concrete building with wallboard broken away to show nailing strips for the wallboard defined by channel-shaped members;

FIG. 7 is a section taken generally along line 7—7 of FIG. 6; and FIG. 8 is a section taken generally along line 8—8 of FIG. 6.

DESCRIPTION OF THE INVENTION

Figure 1:
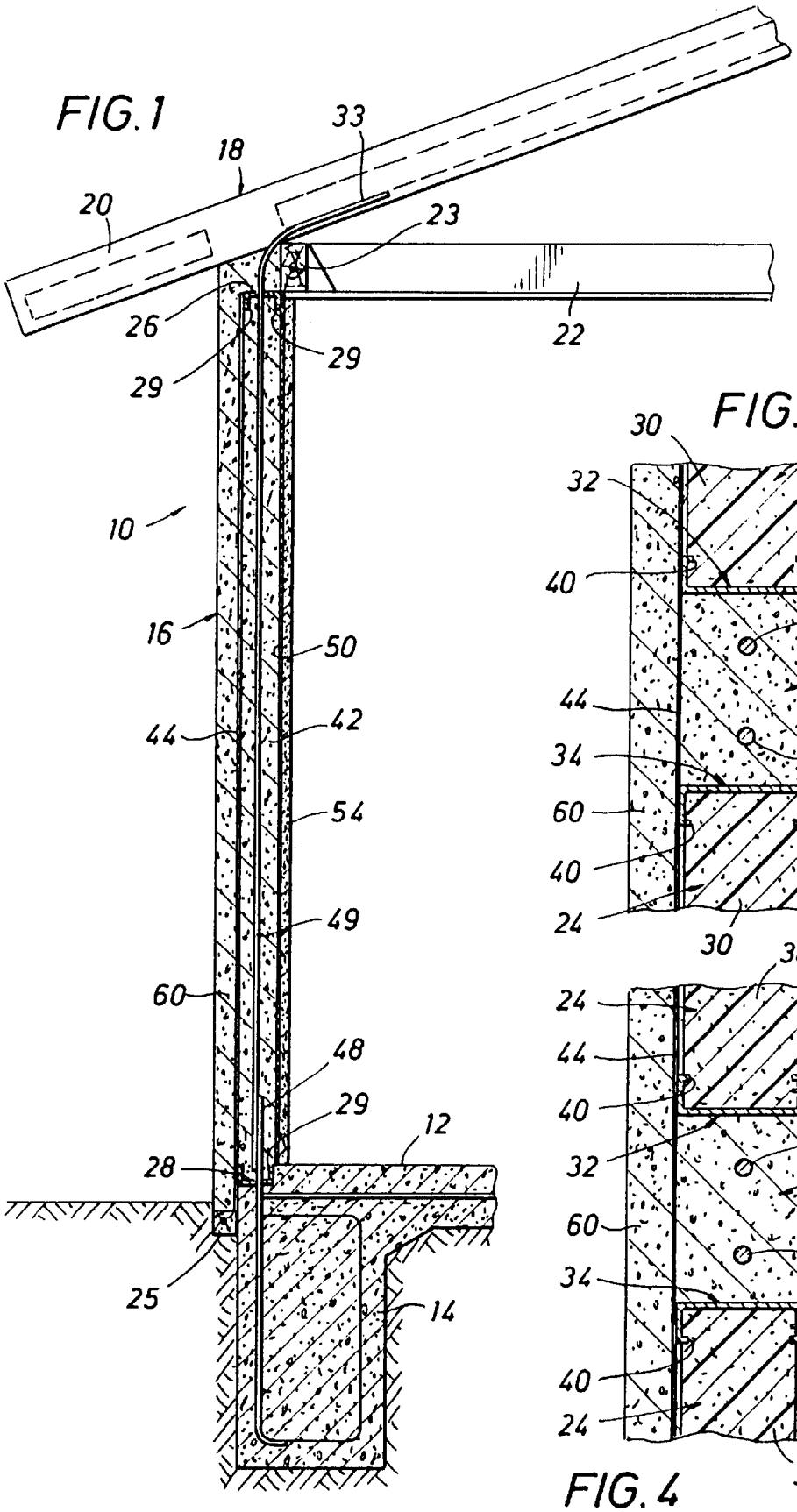
FIG. 1 is a vertical section of a portion of a vertical wall for a reinforced concrete building utilizing construction members which are fabricated on site for the vertical wall of the building.

Referring to the drawings for a better understanding of the invention, a reinforced concrete building as shown particularly at 10 includes a lower concrete floor slab 12 supported by a footing or pier 14. A vertical wall as shown generally at 16 and a roof as shown generally at 18 including a gable 20. Horizontally extending joist 22 extends between walls of the building 10. A wooden nailing member 23 is provided adjacent the outer end of joist 22. A wooden strip 25 is provided on a ledge of foundation 14 to provide a bottom edge for the concrete of vertical wall 16.

Figure 2:
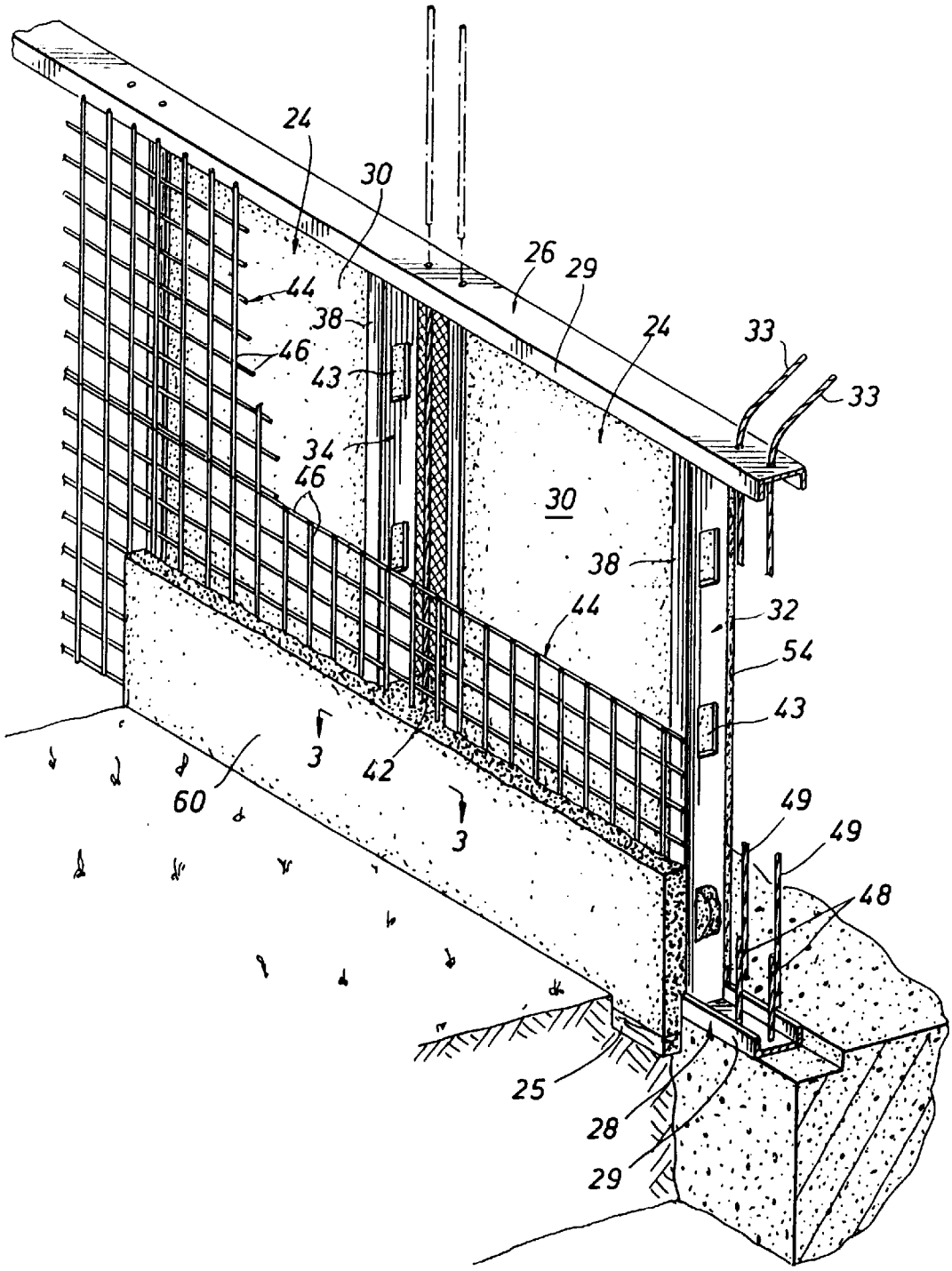
FIG. 2 is perspective view of a front portion of the reinforced concrete building in FIG. 1 showing two spaced units having a column therebetween with concrete on one side of the unit and a drywall panel on the other side, the concrete being broken away to show various construction members.
Figure 5:
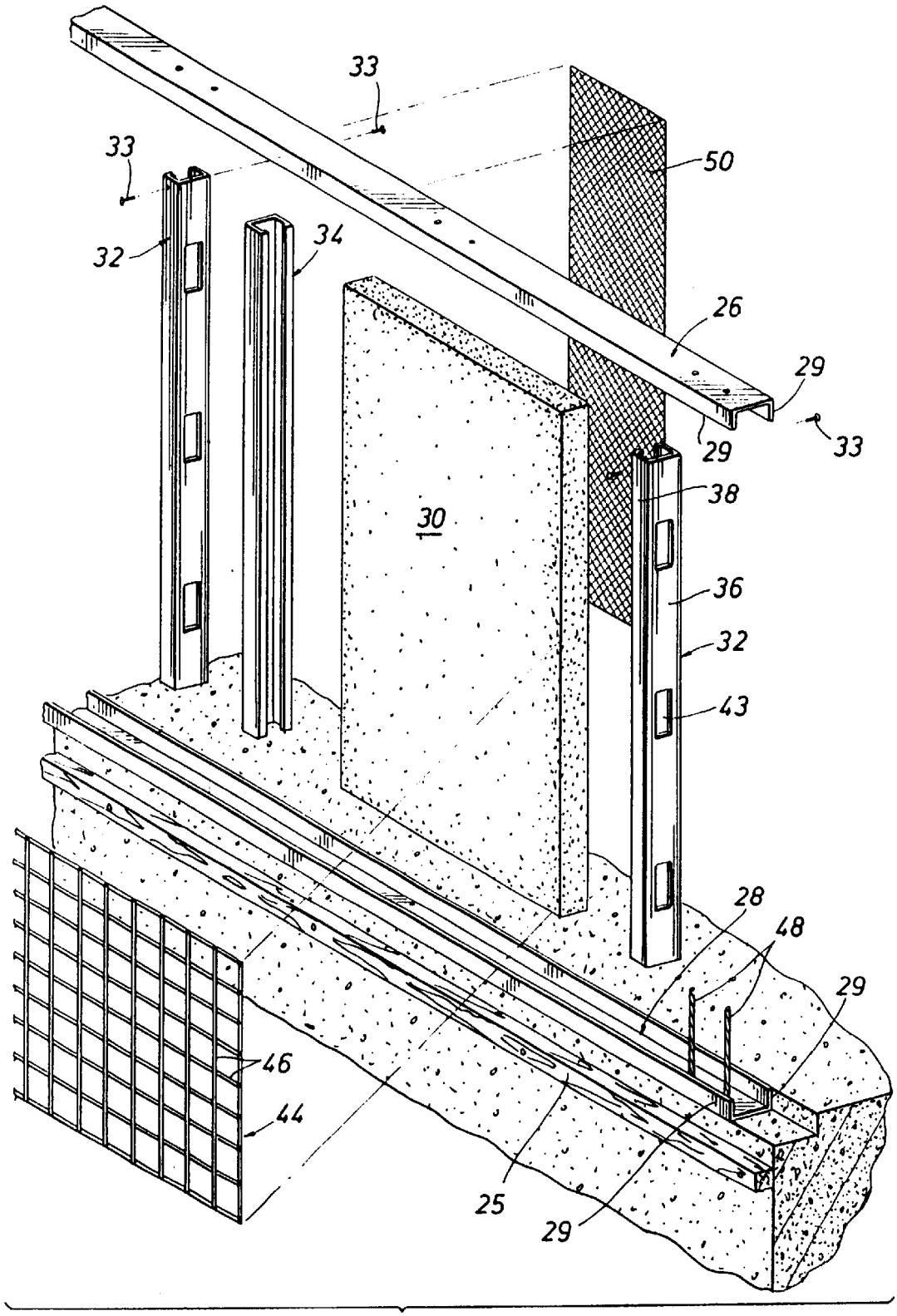
FIG. 5 is an exploded view of the construction members showing a wall unit being formed on site for installation between a pair of upper and lower channel-shaped support plates.

Side wall 16 is formed of a pair of units 24 which are inserted between channel-shaped upper frame track member 26 and lower channel-shaped track frame member 28. Track members 26 and 28 have flanges 29. Each unit 24 is formed on site before units 24 are positioned between upper and lower horizontal track member 26 and 28. Each unit consists of an insulation panel or layer 30 formed of a foam material, such as polystyrene, and opposed vertical side members 32 and 34 as shown particularly in FIGS. 5 and 7. Each vertical side member 32 and 34 is formed of a channel-shape having a body 36 and side flanges 38. Each flange 38 has an inturned lip or tab 40 which bites into foam panel 30 when side members 32 and 34 are pressed into engagement with a vertical side of insulation panel 30 thereby to retain vertical side members 32 and 34 in position on insulation panel 30. Units 34 are positioned and secured between upper and lower horizontal frame members 26 and 28 in horizontal spaced relation to each other to provide a column 42 between opposed vertical side members 32, 34 of adjacent units 24 as shown in FIG. 2. Cutouts or openings 43 are provided in flange 38 for the flow of concrete to provide a bond for the concrete column 42. Flanges 38 of vertical side member 32 are secured to flanges 29 of track members 26 and 28 by suitable screw fasteners shown at 33.

A wire mesh layer generally indicated at 44 is composed of connected wire members 46 to form four inch by four inch openings. Wire mesh layer 44 is mounted on flanges 29 of upper and lower horizontal track members 26 and 28, and flanges 38 of vertical side members 32 and 34 by suitable staples.

Figure 3:
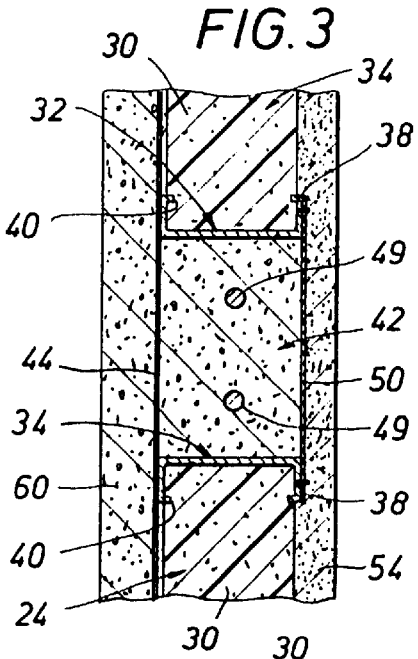
FIG. 3 is a section taken generally along the line 3—3 of FIG. 2.
Figure 4:
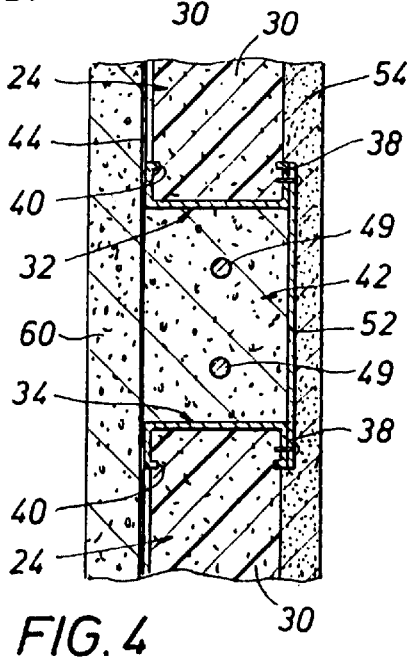
FIG. 4 is a sectional view similar to FIG. 3 but showing a metal plate instead of a wire screen to provide a backing for the concrete column.

To form concrete column 42 between adjacent ends 24, a pair of reinforcing bars 48 extend from foundation 14 as shown particularly in FIG. 2. Intermediate reinforcing bars 49 are connected thereto and are bent at their upper ends to form end portions 33 as shown particularly in FIG. 1 and intermediate reinforcing bars 49 extending therefrom extend through suitable openings in upper track member 24 and are bent to form end portions 33 of the roof 18. A screen wire backing 50 as shown particularly in FIG. 3 has openings about 1/16th inch in width and is secured to flanges 38 of vertical members 32 and 34. The openings in wire screen backing 50 are filled immediately with concrete upon the pneumatic application of concrete to prevent or minimize any blow through of concrete. If desired, a solid plate 52 as shown in FIG. 4 may be substituted for screen wire backing 50 and likewise may be stapled to flanges 38 of vertical side members 32 and 34.

Wallboard panels 54 are shown as mounted on the inner surface of wall 16 and are secured to flanges 38 of vertical members 32, 34 and flanges 29 of horizontal track members 26 and 28 by suitable staples or nails. In addition, foam material 30 of each unit 24 has a separate nailing strip 56 comprising a channel-shaped member similar to track members 26, 28. Nailing strip 56 as shown in FIG. 8 has a body 58 with flanges or legs 60 extending therefrom. Vertical nailing strip 56 may be pressed against foam layer 30 with legs 60 biting into layer 30 for holding nailing strip 56 in position. Suitable staples or nails may be utilized to secure wallboard panel 54 to nailing strips 56.

From the above it is apparent that vertical wall 16 is formed entirely on site without the use of any prefabricated module which are fabricated offsite and transported to the site for assembly. Units 24 are first formed on site by the mounting of vertical side members 32 and 34 on insulation layer 30 which is formed of a foam material such as polystyrene. Inturned lips 40 such as shown in FIG. 7 tend to dig or bite into foam material 30 when side members 32 and 34 are pressed into position on the sides of insulating layer 30. Thus, side members 32 and 34 are easily fitted within channel-shaped track members 26 and 28 where flanges 38 of members 32 and 34 are secured by suitable fasteners, such as screws 33, to flanges 29 of track members 26 and 28.

Concrete 60 is applied pneumatically from the outer side of each wall 16 against insulation panel 30, vertical side members 32, 34 and against wire screen 50 or plate 52 in the space between adjacent opposed side members 32 and 34 to form column 42 between units 24 to cover units 24 and provide a concrete thickness of around one inch outside units 24. The outer concrete surface is screened to a smooth or rough finish as desired on all walls. Then, if desired, a drywall panel 54 is secured to the inner side of wall 16 and is secured to nailing strips 54 and flanges 38 of vertical members 32 and 34 by suitable fasteners, such as nails or staples. In some instances, wallboard layer 54 will not be mounted on the inner surface of wall 16. When wallboard panels 54 are utilized, it is preferable to use metal plate 52 as a backing member for column 42 as a smooth inner surface is provided by plate 52 for wallboard panel 54. It is apparent that a minimum of building members are required for the construction of a vertical reinforced concrete wall in accordance with the present invention.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method of forming on site a vertical wall for a concrete building comprising:

providing a plurality of insulation panel units for the wall with said panel units spaced from each other;

providing a concrete column in the space between adjacent panel units;

forming an insulation panel for each panel unit of a polystyrene foam material having predetermined dimensions, said panel being of a rectangular shape defining a pair of side edges;

providing a pair of opposed vertical studs for each panel unit, each stud having a channel-shape and including a pair of spaced side flanges and an inturned lip on each of the flanges;

assembling said pair of opposed channel-shaped vertical studs over said side edges of said insulation panel with said lips biting into said insulation panel to secure said studs thereon;

providing opposed upper and lower channel-shaped support plates extending horizontally to define upper and lower ends of the vertical wall;

positioning opposed ends of said studs within said channel-shaped support plates, the flanges of said support plates contacting in overlapping relation the flanges of said channel-shaped vertical studs;

mounting fasteners through adjacent flanges of said support plates and said vertical studs to secure said insulation panel in position between said upper and lower support plates; and applying concrete to an outer side of the insulation panel.

2. The method as defined in claim 1, including:

mounting said plurality of insulating panel units between said upper and lower channel-shaped plates, the panel units being spaced from each other at a predetermined distance;

providing a separate backing member between adjacent panel units to span the space between the adjacent units; and applying concrete pneumatically from the outer side of said vertical wall to form said concrete column in the space between the adjacent units.

3. The method as defined in claim 2, including:

securing a layer of wire mesh reinforcing material on each insulating panel unit mounted on the flanges of said studs; and providing vertically extending reinforcing bars in the space between adjacent insulating panel units prior to the application of the concrete.

4. The method as defined in claim 3, including:

mounting a plurality of channel-shaped nailing strips in the space between adjacent units on an inner surface of said polystyrene insulating panels with the flanges of said channel-shaped nailing strips biting into the insulating panels to secure the insulating panels thereon;

mounting a plurality of wallboard panels onto said insulation panels of said units; and mounting fasteners on said wallboard panels and said nailing strips for securing said wallboard panels thereon.

5. A method of constructing a concrete building having at least one vertical concrete wall, said method comprising:

providing a plurality of insulation panel units for vertical walls, each unit comprising an insulation panel of a polystyrene foam material band being of a rectangular shape defining a pair of side edges, and a pair of opposed vertical studs having a channel shape including spaced side flanges and inturned lips on said side flanges having free edges, the opposed channel-shaped vertical studs fitting over the side edges of the insulation panel with the side flanges and lips biting into the insulation panel to secure the studs thereon;

providing opposed upper and lower channel-shaped support plates extending horizontally to define the upper and lower ends of the vertical wall;

positioning the plurality of insulating panel units between said upper and lower channel-shaped support plates with said units being spaced from each other a predetermined distance;

positioning the opposed ends of the studs within the channel-shaped support plates with the flanges of the support plates contacting and overlapping the flanges of the channel-shaped vertical studs;

mounting fasteners to adjacent flanges of the support plates and vertical studs to secure the insulation panel units in position between said upper and lower support plates; and applying concrete from the outer side of the vertical wall to the plurality of insulating panel units to cover the insulating panel units and to form concrete columns in the space between adjacent units.

6. The method as defined in claim 5, including:

securing a layer of wire mesh reinforcement material for each unit to flanges of the studs on the outer side of the vertical wall.

7. The method as defined in claim 6, including:

providing a separate backing member to span the space between adjacent units, the backing member secured to flanges of opposed studs of adjacent insulating panel units.

8. The method as defined in claim 7, including:

providing wallboard on the side of said insulating panel units opposite the wire mesh material.

9. The method as defined in claim 8, including:

providing a plurality of wallboard nailing strips on each insulation panel with the nailing s tri ps including channel-shaped members having flanges pressed into the polystyrene foam material from which the insulation panels are formed.

10. A concrete building having at least one vertical wall, the wall comprising:

a plurality of insulation panel units spaced from each other;

a concrete column in the space between adjacent panel units;

an insulation panel for each panel unit of a polystyrene foam material having predetermined dimensions, said panel being of a rectangular shape and defining a pair of side edges;

a pair of opposed vertical studs for each panel unit, each stud having a channel-shape and including a pair of spaced side flanges and an inturned lip on each of the flanges;

said pair of opposed channel-shaped vertical studs adjoining said side edges of said insulation panel with said lips biting into said insulation panel to secure said studs thereon;

opposed upper and lower channel-shaped support plates extending horizontally to define upper and lower ends of the vertical wall;

opposed ends of said studs positioned within said channel-shaped support plates, the flanges of said support plates contacting in overlapping relation the flanges of said channel-shaped vertical studs;

a plurality of fasteners to secure said insulation panel in position between said upper and lower support plates; and concrete covering an outer side of the insulation panel.

11. The concrete building as defined in claim 10, further comprising:

said plurality of insulating panel units spaced between said upper and lower channel-shaped plates, the panel units being spaced from each other at a predetermined distance; and a backing member between adjacent panel units to span the space between the adjacent units.

12. The concrete building as defined in claim 10, further comprising:

a layer of wire mesh reinforcing material on each insulating panel unit secured to the flanges of said studs.

13. The concrete building as defined in claim 12, further comprising:

a plurality of channel-shaped nailing strips in the space between adjacent units on an inner surface of said polystyrene insulating panels, the flanges of said channel-shaped nailing strips biting into the insulating panels to secure the insulating panels thereon.

14. A building as defined in claim 10, further comprising:

vertically extending reinforcing bars in the space between adjacent insulating panel units.

15. The concrete building as defined in claim 10, further comprising:

a plurality of wallboard panels mounted on said insulation panels of said units; and a plurality of fasteners securing said wallboard panels to said insulation panels.

* * * * *

UNITED STATES PATENT AND TRADEMARK OFFICE

CERTIFICATE OF CORRECTION

PATENT NO. : 6,519,904 B1
DATED : February 18, 2003
INVENTOR(S) : Charles N. Philips It is certified that error appears in the above-identified patent and that said Letters Patent is hereby corrected as shown below:

Column 5,
Line 56, change “s tri ps” to -- strips --.

Signed and Sealed this

Twenty-second Day of April, 2003

JAMES E. ROGAN
*Director of the United States Patent and Trademark Office*